United States Patent [19]

Alvin

[11] Patent Number: 4,615,064

[45] Date of Patent: Oct. 7, 1986

[54] LATERAL STREET CLEANING BRUSH

[75] Inventor: Pierre L. M. Alvin, 2, avenue du Mont-Saint-Jean, F 066000 Antibes, France

[73] Assignee: Pierre L. M. Alvin, Antibes, France

[21] Appl. No.: 638,646

[22] Filed: Aug. 7, 1984

[30] Foreign Application Priority Data

Aug. 8, 1983 [FR] France ..... 83 13030

[51] Int. Cl.[4] ..... A46B 13/02

[52] U.S. Cl. ..... 15/180; 15/49 R; 15/186

[58] Field of Search ..... 15/180, 196–200, 15/168, 169, 49 R, 50 R, 52, 176, 202, 230

[56] References Cited

U.S. PATENT DOCUMENTS

| | | | |
|---|---|---|---|
| 2,853,729 | 9/1958 | Link . | |
| 3,678,530 | 7/1972 | Horton et al. | 15/180 |
| 4,236,269 | 12/1980 | Block | 15/180 |

FOREIGN PATENT DOCUMENTS

| | | | |
|---|---|---|---|
| 1428460 | 11/1962 | Fed. Rep. of Germany . | |
| 1657302 | 2/1971 | Fed. Rep. of Germany | 15/180 |
| 10058048 | 5/1952 | France . | |
| 2213036 | 1/1974 | France . | |
| 8313030 | 6/1984 | France . | |
| 759082 | 4/1954 | United Kingdom . | |
| 2035066 | 11/1979 | United Kingdom . | |

*Primary Examiner*—Timothy F. Simone

*Attorney, Agent, or Firm*—Cushman, Darby & Cushman

[57] ABSTRACT

The invention relates to a street-cleansing brush for lateral sweeping, in which the fibers are disposed under a support plate mounted to rotate about an axis perpendicular to said plate, wherein it is constituted by a plurality of supports in the form of sectors of ring in each of which said fibers are implanted and by a plate of which the lower face is provided with means for removably coupling and retaining each of said sectors. The invention is particularly applicable to street-cleansing equipment.

5 Claims, 4 Drawing Figures

LATERAL STREET CLEANING BRUSH

The present invention relates to a brush adapted to be fitted on street cleansing machines as gutter or lateral brush.

On the side of this type of machine, a support plate is provided, presenting at its centre a hub for coupling to a drive shaft. This plate is adapted to receive the actual brush, which is generally constituted by a disc of plywood in which the fibers for sweeping are implanted. Brushes also exist in which the disc is made of metal and divided into two, three or four segments which are assembled on the support plate.

The brush, in one piece or in segments, is always fixed by means of screws, this presenting numerous drawbacks when assembling and dismantling. In fact, access to these screws is not easy and they are often positioned at the centre of the zone of fibers. The operator is in that case subjected to numerous scratches or pricks which, particularly when the fibers are well-worn, are numerous causes of infection, especially when the screws vary in number from four to twelve, depending on the dimensions of the disc.

In addition, the known brushes present the drawback of being of cumbersome volume with low weight, when they are provided with fibers, and are difficult to handle. This is particularly true for one-piece brushes made of wood. For segmented brushes, their weight is much greater, which is also disadvantageous. These brushes are also expensive to make, whether they are made in one piece, of wood, involving the use of a large quantity of wood and expensive unitary machining, of plastics material treated like plywood, or of a light alloy which is of high cost price.

It is an object of the present invention to overcome these drawbacks by proposing a novel design of brush in which the whole of the brush is constituted from modules or segments coupled in simple manner to a support or drive disc. One of the advantages of the invention lies in the fact that each module is substantially identical to all the others, and this whatever the dimensions of the brush to be constituted. In this way, each segment comprises a standard part or zone of implantation of the fibers which is reproduced in all the modules as well as a likewise standard part for fixation. Only a few dimensions and outer curvatures vary from one type of module to the other for precise fit thereof on the support disc of given dimensions. Fittings of very similar weight, volume and dimensions are thus available for fitting discs of different diameters, the number of segments naturally varying from one disc to the other. It follows that manufacture of these segments, particularly by injection of plastics material, may be effected with a mould of which only the outer walls are to be changed or moved to pass from one type of segment to the other, the important mechanisms of cores for the orifices for implantation of the fibers or for the formation of the clipping member remaining identical. In addition to easy assembly and dismantling, this results in inexpensive manufacture which requires only minimum investment in the moulds.

The invention therefore relates to a brush for laterally sweeping streets, in which the fibers are disposed beneath a support plate mounted to rotate about an axis perpendicular to said plate. According to one of the principal features of the invention, thus brush is constituted by a plurality of supports in the form of sectors of ring in each of which said fibers are implanted and by a plate whose lower face is provided with means for removably coupling and retaining each of the said sectors.

In a preferred embodiment of the invention, said coupling and retaining means are constitued, for each sector, by two radial slides, fast with the plate, cooperating with the substantially radial edges of said sector and by elastic clipping elements provided respectively on the plate and each sector.

Whatever the dimensions of the brush for which it is intended, each sector advantageously comprises, in standard fashion, a central zone provided with a plurality of pairs of parallel orifices for fixation of the said fibers, this zone being bordered by an outer arc of circle and radial edges whose relative positions with respect to said zone are a function of the said dimensions.

Furthermore, said clipping elements are constituted by a peg which is fast with said plate and by an elastic clip, in one piece with said sector which extends towards the centre thereof, along its bisecting radius and whose position with respect to the central zone is constant whatever the type of sector.

It is also an object of the invention to provide an element for fitting the said street cleansing brush which is constituted by a support in the form of a sector of ring in which the fibers for sweeping are implanted, whose radial edges are profiled in a section whose shape is complementary of that of fixing slides and which comprises, in one piece, along its bisecting radius, towards the centre, an elastic clip.

Finally, this element is characterized in that it comprises a plurality of pairs of parallel through orifices in a determined orientation, each pair receiving the arms of a bundle of fibers formed as a staple overlapping the wall separating two orifices of the same pair, and in that said radial edges constitute flanges in elevation with respect to the upper plane of the sector defining therebetween a volume for housing all the bends of said staples.

The invention will be more readily understood on reading the following description with reference to the accompanying drawings, in which.

Figure 1:
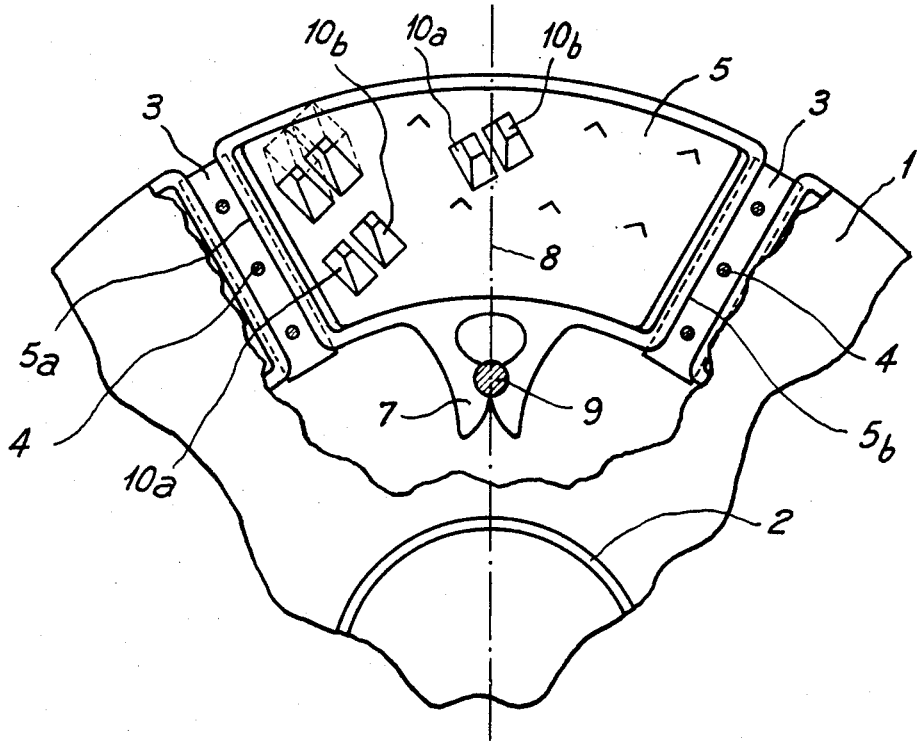
FIG. 1 is a partial schematic plan view of a brush according to the invention.
Figure 1B:
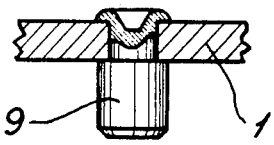
FIGS. 1A and 1B are views in detail of FIG. 1.
Figure 1A:
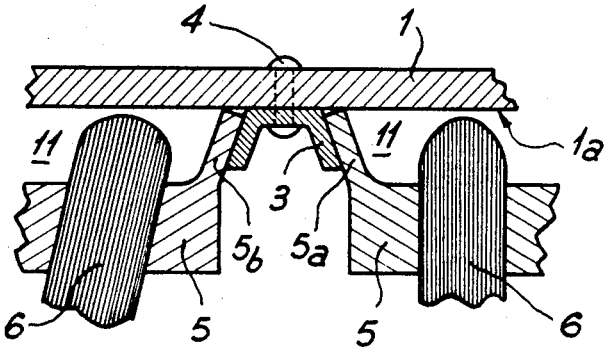

Referring now to the drawings, FIGS. 1, 1A and 1B show a support plate 1, partially torn in FIG. 1, which comprises at its centre a hub 2 for coupling to a drive shaft (not shown). The plate is therefore driven in rotation in its plane about the axis of hub 2. Regularly distributed on the lower surface 1*a* of this plate are disposed radial slides 3 which are fixed to the plate by any appropriate means such as rivets 4. As shown in FIG. 1A, these slides are constituted by a metal sheet bent as a V. A sector of ring 5 made of plastics material constitutes a member 6 for holding fibers for sweeping (shown only in FIG. 1A) and cooperates with slides 3 by its lateral (radial) edges 5*a* and 5*b*. It will be noted that the inclination of these edges 5*a* and 5*b* is identical to that of the arms of the V of each slide 3 and when the sector 5 is introduced radially between two slides 3, a dovetail-type fit is produced between the arms of the slides and the said edges 5*a* and 5*b* which joins the sector 5 to the plate 1.

The fixation thus effected is locked by means of a clip 7, made in one piece with the sector 5 whose arms are directed towards the centre of the sector and extend on either side of its bisecting radius 8, which, at the moment of fit, tightens around a peg 9 fast with the plate 1 (FIG. 1B).

The sweeping fibers 6 may be implanted in the sector 5 in any known manner. A particularly advantageous mode of fixing the fibers consists in forming them as a bundle in the form of a staple of which each of the arms is introduced into one of the orifices 10*a*, 10*b* of one of the pairs of through orifices with which the sector 5 is provided. FIG. 1 shows three of such pairs of orifices 10*a*, 10*b* and the outermost angle of each of the other six pairs has been sketched. These orifices presents, per pair, a determined orientation which is a function of the nature of the fiber in order to give all of them a precise direction to place them under optimum working conditions. This orientation may firstly be an outward inclination with respect to the axis of the brush. When the fibers are thus in staple form, it is necessary to arrange a space 11 between the sector 5 and the lower face 1*a* of the plate 1 for the passage of the loop of the staple above each wall separating the orifices of one pair. This space results from the configuration of the lateral (radial) edges 5*a* and 5*b* of each sector 5 in elevation with respect to the upper plane of the sector itself.

It is seen that the arrangement according to the invention, as described hereinabove in the form of an embodiment, allows extremely easy assembly by fitting and clipping each sector on the periphery of the plate 1, eliminates any use of a tool, renders filling or emptying of a street cleansing machine very accessible without requiring dismantling of the drive plate 1, and eliminates any risk of injury to the operator.

Figure 2:
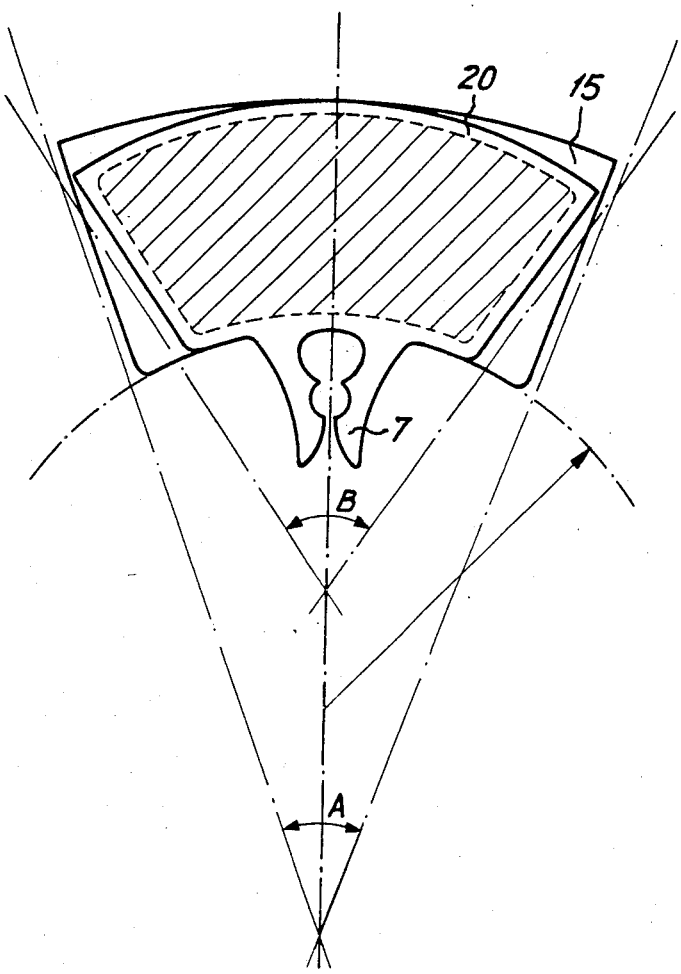
FIG. 2 is a diagram showing two extreme configurations of a fiber supporting sector constituting the brush according to the invention.

Other advantages will be apparent from FIG. 2, which schematically shows two types of sectors according to the invention embracing a range of intermediate dimensions (not shown). The sector referenced 15 corresponds to a large diameter of brush with an angle at centre A of 40°. A brush is thus constituted by positioning nine sectors on the periphery of a support plate. The sector 20 is adapted to equip a brush of small diameter with an angle at centre B of 72°, or five sectors per brush. This diagram shows that these two sectors have in common their clip 7 and the zone of implanatation of the fibers (hatched in the Figure). Only the outer curvature and the inclination of the radial sides differ. By this design, it is easy to manufacture all types of sectors included between these two extremes 15 and 20 by means of one mould (by injection of plastics material in particular) which would have mobile lateral walls and an end wall either of variable curvature or interchangeable with walls of different curvatures. The complex mechanism of the mould (the slides necessary for making the orifices for implantation of the fibers, the elements for moulding the clip) would remain fixed and adapted to all types. This results in a considerable rationalization of manufacture which leads to an extremely low cost price. By way of indication, mention will be made of the possibility of making brushes ranging from 320 to 550 mm diameter of the support with, respectively, five sectors for diameter 320, six sectors for diameters 360 and 400, seven sectors for diameter 450, eight sectors for diameter 500 and nine sectors for diameter 550.

Finally, as is shown in FIG. 2, the dimensions of each type of sector is substantially equivalent to those of the other types, which also allows rationalized transport and storage.

The invention finds particular application in street cleansing equipment.

What is claimed is:

1. A street-cleansing brush for lateral sweeping, comprising:

a circular support plate adapted to be mounted to rotate about a substantially vertical axis;

a plurality of fiber-carrying supports in the form of ring sectors each having opposite radially extending edges; and means for removably coupling and retaining each of said sectors to and under said plate, said coupling and retaining means for each sector comprising two circumferentially spaced radially extending slides fixed to the underside of said plate and underlying and overlapping said opposite radially extending edges of the corresponding sector and clipping elements fixed respectively on said plate and the corresponding sector and interengageable on forceful radial inward movement of said sector relative to said plate to retain said sector against radial outward movement relative to said plate due to centrifugal force.

2. The brush of claim 1 wherein each sector has a central zone provided with a plurality of pairs of parallel orifices for the fixation of fibers to the sector by the looping of a bundle of the fibers through the orifices of each pair.

3. The brush of claim 1 wherein the clipping elements comprise a peg fixed to and depending from the underside of the plate and an elastic clip, in one piece with the corresponding sector at its radial inner portion, and which extends in the direction of the center of the sector substantially along the latter's bisecting radius.

4. The brush of claim 1 wherein the slides and the corresponding radially extending edges of each sector have a complementary dovetail interengagement inclined relatively to the plane of the plate to affect a wedging action to securely fasten each sector to said plate.

5. A fiber-carrying support for a street cleansing brush having a circular plate rotatable about a vertical axis, said support comprising a ring sector adapted to be fastened to and beneath the underside of the plate and having radially extending opposite edges and a plurality of pairs of parallel through orifices, the orifices of each pair being adapted to have a bundle of fibers looped therethrough with the arms of the loop extending outward from the sector underside, said radially extending edges of said sector having raised upper margins to space the upper side of said sector between said margins from the underside of the plate to accommodate the bases of the fiber loops.

* * * * *